US008763886B2

(12) United States Patent
Hall

(10) Patent No.: US 8,763,886 B2
(45) Date of Patent: Jul. 1, 2014

(54) INSULATING SHIPPING SYSTEM

(75) Inventor: Christopher Edward Hall, Sewickley, PA (US)

(73) Assignee: Alpine Thermal Technologies, Inc., Moon Township, PA (US)

( * ) Notice: Subject to any disclaimer, the term of this patent is extended or adjusted under 35 U.S.C. 154(b) by 183 days.

(21) Appl. No.: 13/292,284

(22) Filed: Nov. 9, 2011

(65) Prior Publication Data

US 2013/0112695 A1 May 9, 2013

(51) Int. Cl.

| | |
|---|---|
| ***B65D 81/38*** | (2006.01) |
| ***B31B 1/02*** | (2006.01) |
| ***B31B 17/00*** | (2006.01) |
| ***B31B 1/26*** | (2006.01) |
| ***B31B 11/02*** | (2006.01) |
| ***B65D 5/42*** | (2006.01) |
| ***B31B 1/50*** | (2006.01) |

(52) U.S. Cl.

USPC ..... 229/103.11; 220/592.25

(58) Field of Classification Search

CPC ..... B65D 2585/6837; B65D 5/326; B65D 5/48024; B65D 5/5023; B65D 5/505; B65D 85/30

USPC ..... 229/103.11, 919; 493/122, 903, 390, 493/137; 206/433, 593

See application file for complete search history.

(56) References Cited

U.S. PATENT DOCUMENTS

| | | | | |
|---|---|---|---|---|
| 4,010,865 | A | 3/1977 | Wilgus | |
| 4,401,257 | A | 8/1983 | Benham | |
| 5,154,309 | A | 10/1992 | Wischusen, III et al. | |
| 5,201,868 | A | 4/1993 | Johnson | |
| 5,441,170 | A * | 8/1995 | Bane, III | 229/103.11 |
| 6,474,473 | B2 * | 11/2002 | Wong | 206/590 |
| 6,536,654 | B2 * | 3/2003 | Reynolds et al. | 229/103.11 |
| 6,997,323 | B2 * | 2/2006 | Maresh et al. | 206/592 |
| 7,270,234 | B2 | 9/2007 | Hodsdon | |
| 7,452,316 | B2 | 11/2008 | Cals et al. | |
| 7,624,911 | B2 | 12/2009 | Spurrell | |
| 7,870,992 | B2 | 1/2011 | Schille | |
| 2007/0051782 | A1 | 3/2007 | Lantz | |
| 2009/0193765 | A1 | 8/2009 | Lantz | |
| 2010/0062921 | A1 | 3/2010 | Veiseh | |
| 2011/0042449 | A1 | 2/2011 | Copenhaver | |
| 2011/0114513 | A1 * | 5/2011 | Miller | 206/204 |

OTHER PUBLICATIONS

Control Temp Classic, available at http://www.rncind.com/index.php?page=control-temp-classic.

2. KoolTempTM PUR Polyurethane Insulated Shipping Container, available at http://www.coldchaintech.com/products/kooltemp-polyurethane-insulated-containers.php.

International Searching Authority (ISA/US), International Search Report and Written Opinion of the ISA, for PCT/US12/63732, Mailing Date Mar. 8, 2013, 9 pages.

* cited by examiner

*Primary Examiner* — Gary Elkins
*Assistant Examiner* — Christopher Demeree
(74) *Attorney, Agent, or Firm* — Beem Patent Law Firm

(57) ABSTRACT

An insulating shipping system may include a container and an insert assembly which may include an insert configured to be inserted into the container. The insert may have a first blank that may include a center panel, two bottom panels emanating from opposite side edges, wherein each bottom panel has at least one slot, at least one top panel emanating from a top edge of each of the bottom panels, wherein each top panel has at least one tab or flange, and at least one foldable line of weakness disposed between each top panel and bottom panel, wherein the at least one slot is sized to receive the at least one tab or flange. The insert further may include a second blank have a center panel, wherein the center panel is configured to couple to the center panel of the first blank to form at least one walled cavity.

14 Claims, 10 Drawing Sheets

INSULATING SHIPPING SYSTEM

BACKGROUND OF THE INVENTION

1. Field of the Invention

The present invention is directed generally to the field of insulated shipping systems.

2. Description of the Related Art

Various containers are designed to transport temperature sensitive items. Such containers traditionally are fabricated entirely from foam based technologies, such as expanded polystyrene (EPS) and/or urethane, wherein the foam based technologies generally provide insulation during transportation. Most foam based technologies and/or products are not recyclable, at least not in the main recycling streams. Foam based technologies and/or products usually are bulky and require a great deal of space to be shipped, which generally increases shipping costs.

Other containers that are configured to transport temperature sensitive items may include a combination of materials, such as foam based technologies and/or paperboard. Most containers of this nature are not recycled, because the materials generally must be separated from one another to be recycled in the mainstream. Moreover, these containers generally are not reused. Containers that are not recycled and not reused may end up in landfills, which may have negative effects on the environment.

Additionally, some insulated containers use materials such as mineral rock wool as insulation. Mineral rock wool is very dense and carries significant weight penalties when shipped, which may increase the cost to ship the container. Further, mineral rock wool utilizes no post consumer recycled content and is not recyclable into the paper or poly waste streams.

What is needed is a container that overcomes these drawbacks. Specifically, the cold chain shipping market—the market that ships temperature sensitive items, such as food and pharmaceuticals—has long expressed a desire for a "green package" alternative to expanded polystyrene coolers and urethane shippers that does not carry a weight or cost penalty.

SUMMARY OF THE INVENTION

In one aspect, a system is disclosed. The system may include a container and an insert assembly. The insert assembly may include an insert configured to be inserted into the container, wherein the insert is fabricated from at least two blanks. For example, a first blank may include a center panel, two bottom panels emanating from opposite side edges of the center panel, wherein each bottom panel has at least one slot, and at least one top panel emanating from a top edge of each of the bottom panels, wherein each top panel has at least one tab or flange, and at least one foldable line of weakness disposed between each top panel and bottom panel, wherein the at least one slot of each bottom panel is sized to receive the at least one tab or flange therein. The insert further may include a second blank having a center panel, wherein the center panel of the second blank is configured to couple to the center panel of the first blank to form at least one walled cavity.

In another aspect, a blank for forming an insert is disclosed. The blank may include a center panel, and two bottom panels emanating from opposite side edges of the center panel, wherein each bottom panel has at least one slot, and at least one top panel emanating from a top edge of each of the bottom panels, wherein each top panel has at least one tab or flange, and at least one foldable line of weakness and at least one flap disposed between each top panel and bottom panel, wherein the at least one slot of each bottom panel is sized to receive the at least one tab or flange therein.

In a further aspect, a method for forming an insert is provided. The method may include the steps of providing a first blank having a center panel, providing two bottom panels emanating from opposite side edges of the center panel, wherein each bottom panel has at least one flap having at least one slot, providing at least one top panel emanating from a top edge of each of the bottom panels, wherein each top panel has at least one flap having at least one tab or flange, providing at least one foldable line of weakness disposed between each top panel and bottom panel, rotating each top panel along the at least one foldable line of weakness towards each respective bottom panel, inserting the at least one tab or flange of each top panel flap into at least one slot of each bottom panel flap to couple the top panel and bottom panel together to form at least two separate walled cavities, providing a second blank having a center panel, and coupling the center panel of the first and second blanks together to form at least one additional walled cavity.

In yet another aspect, a method for forming a system. The method may include the steps of providing at least six insulating pads, providing at least two sleeves formed from a biodegradable material, inserting at least three insulating panels into at least one sleeve, inserting the remaining three insulating panels into the other sleeve, folding each of the two sleeves into a C-shape, wherein each insulating pad creates a wall of the C, coupling the two C-shaped sleeves together to form a walled interior cavity, and inserting the sleeves into a container.

In a further aspect, a system is disclosed. The system may include a container and an insert assembly that may include an insert configured to be inserted into the container, wherein the insert is fabricated from at least one blank. The blank may include a center panel, two bottom panels emanating from opposite side edges of the center panel, wherein each bottom panel has at least one slot, at least one top panel emanating from a top edge of each of the bottom panels, wherein each top panel has at least one tab or flange, at least one foldable line of weakness disposed between each top panel and bottom panel, such that the top panel is configured to rotate around the at least one foldable line of weakness and the at least one tab or flange of the at least one top panel is inserted into the at least one slot of the at least one bottom panel forming at least one walled cavity.

In another aspect, a system is disclosed. The system may include a container, and an insert assembly comprising at least one insert configured to be inserted into the container, the at least one insert is fabricated from a recyclable material and is configured to form at least one walled cavity, wherein the at least one walled cavity is accessible and is configured to receive an insulating material therein. The insert assembly, when in an articulated position, may be configured to form a cavity within the container.

These and other features and advantages are evident from the following description, with reference to the accompanying drawings.

DETAILED DESCRIPTION OF THE INVENTION

Figure 1:
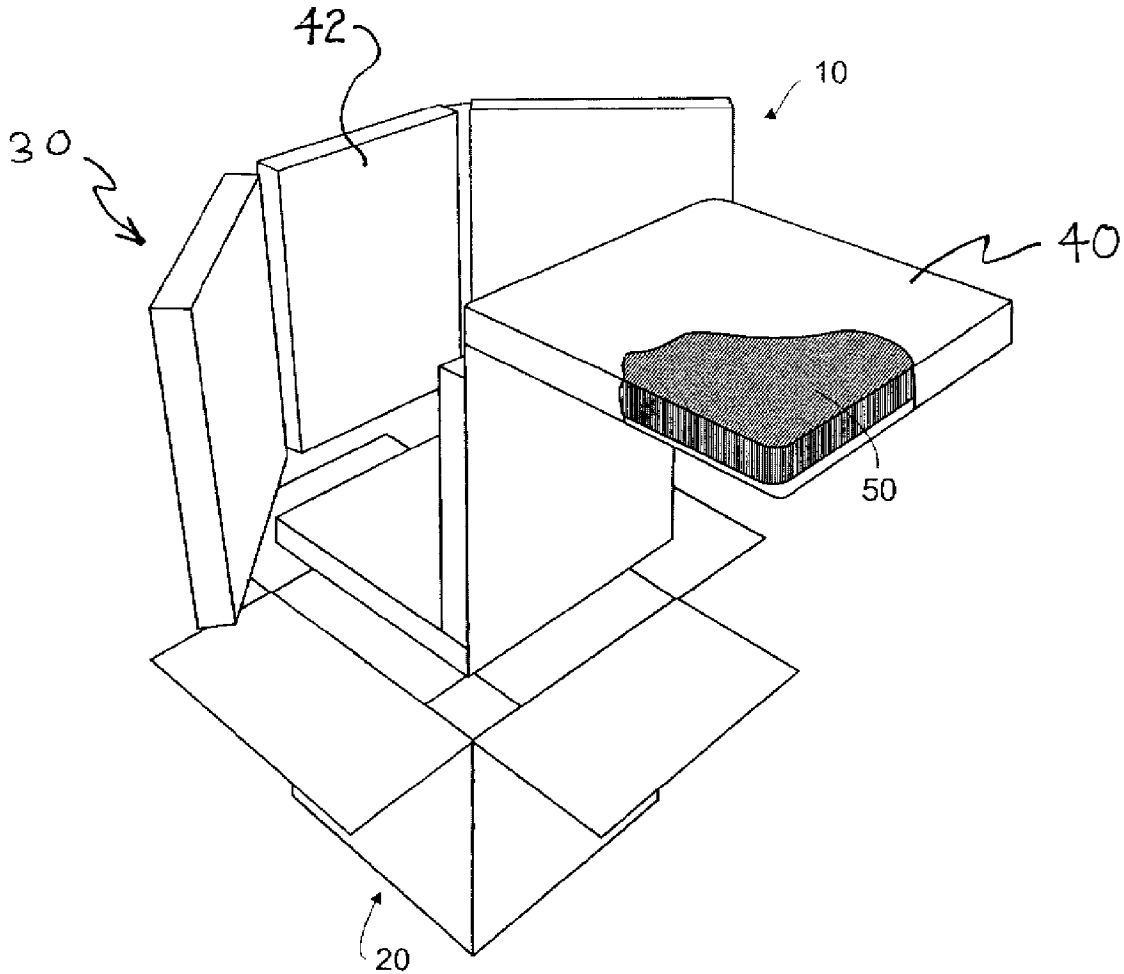
FIG. 1 is a perspective view of one embodiment of a system, having a container and at least one insert, shown in an exploded configuration.

While this invention is shown in the drawings and will be described in detail, the embodiments are described with the understanding that the present disclosure is to be considered as an exemplification of the principles of the invention and is not intended to limit the invention to the embodiments illustrated.

When referring to the plan illustrations of the blanks, the usual drawing conventions are applied. That is, unless otherwise noted, broken lines indicate lines of weakness, such as fold or score lines, which facilitate rotating or folding portions of a blank; and interior solid lines indicate through-cuts. Also, when score lines and/or fold lines are referred to herein, in alternative embodiments, a score line may be replaced with a fold line or another line of weakness, and/or a fold line may be replaced with a score line or another line of weakness.

Additionally, when flanges and/or tabs are referred to herein, in alternative embodiments, a flange may be replaced with a tab or another projection, and/or a tab may be replaced with a flange or another projection. Moreover, when notches and/or slots are referred to herein, in alternative embodiments, a notch may be replaced with a slot or another cut, and/or a slot may be replaced with a notch or another cut.

In preferred embodiments, the blanks are fabricated from corrugated paperboard material, although other materials having similar suitable performance characteristics may be employed if desired. For example, other materials may include paperboard, cardboard, plastic, aluminum foil, or biodegradable material, such as a biodegradable film or paper. The blanks may have a thickness between about 0.05" and about 0.5", preferably between about 0.1" and about 0.4", and more preferably about 0.25".

Moreover, in some embodiments, blanks may be fabricated, erected and/or articulated using adhering or adhesive materials, such as tape, glue, and/or a sealant. When adhesive materials are used, one or more layers may be added. In other embodiments, blanks may be fabricated, erected and/or articulated without adhering or adhesive materials. For example, tabs, flanges, slots and/or notches may be used to fabricate, erect and/or articulate a blank.

As described herein, a cellulose fiber insulated shipping system 10 is designed to provide companies transporting temperature sensitive items with a cost effective, lightweight, environmentally correct (recyclable) alternative to existing foam based technologies. Particularly, system 10 may use a paper based technology with high performance.

As shown in FIG. 1, system 10 may include an outer or exterior shipping container 20 and an insert assembly or subassembly 30 configured to be inserted within container 20 to maintain the temperature within container 20. Insert subassembly 30 may include at least one insert 40 and at least one insulating pad 50.

The cellulose fiber insulated shipping system 10 may include a six panel container having an insulated container liner or insert. In one embodiment, the insert may be designed as two interlocking "C" shaped inserts 30 that form six insulating walls and fit precisely or snuggly together and may fit inside an outer corrugated container 20. A two-part insert design offers the advantage of being light weight, particularly due to the low density of the cellulose insulation pad 50, and quick assembly.

Insulating panel or pad 50 may provide thermal insulation to goods placed within container 20 and may be manufactured using primarily post consumer recycled (PCR) content, such as newsprint and other lightweight recycled papers. The insulating performance ("R" value) of system 10 is significantly better than foam based technology of expanded polystyrene and offers equivalent or better performance at between about 50% and about 75%, specifically about 67% of the wall thickness.

Moreover, system 10 described herein has numerous advantages. For example, pad 50 may have a minimum of 70% post consumer recycled content (such as cellulose) by weight. System 10 may be recycled in the paper waste recycling stream. Additionally, system 10, including container 20 and the insert assembly, ships in a knocked down flat configuration and is lighter than other systems, which may provide freight savings. System 10 also provides a stable temperature which is important for shipping temperature sensitive items.

This new cellulose fiber insulated shipping system 10 meets industry price and performance targets.

I. Blank 100, Container 20

Figure 2:
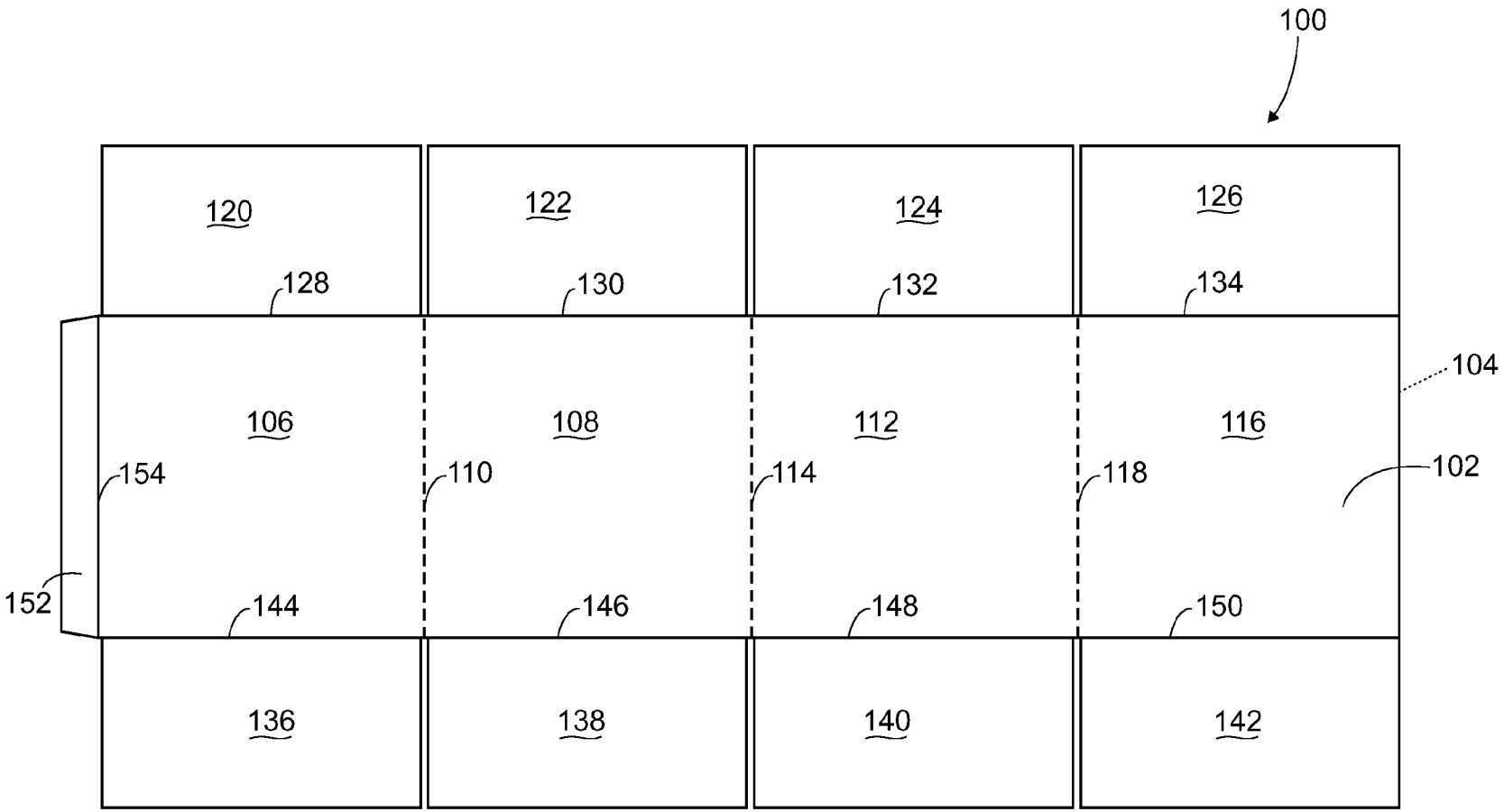
FIG. 2 is a plan view of a blank for forming the container according to the embodiment of FIG. 1.

Turning to FIG. 2, as described herein, container 20 may be assembled from a blank 100 that has an inner surface 102 and an outer surface 104 and that may include a plurality of panels. For example, blank 100 may include a first panel 106, a second panel 108 emanating from first panel 106 along a fold line 110, a third panel 112 emanating from second panel 108 along a fold line 114, and a forth panel 116 emanating from third panel 112 along a fold line 118. Blank 100 further may include top panels and bottom panels. Top panels 120, 122, 124, 126 may emanate from panels 106, 108, 112, 116, along fold lines 128, 130, 132, 134, respectively. Bottom panels 136, 138, 140, 142 may emanate from panels 106, 108, 112, 116, along fold lines 144, 146, 148, 150, respectively. Blank 100 additionally may include a closure flap 152 emanating from panel 106 along a fold line 154. Fold lines 110, 114, 118 and 154 may be substantially parallel with respect to one another.

In one embodiment, panels 106, 108, 112, 116, 120, 122, 124, 126, 136, 138, 140, 142 may have a substantially rectangular or square shape, and closure flap 152 may have a substantially trapezoidal shape. Alternatively, panels of blank 100 may have any suitable shape and/or size that facilitates articulation of container 20.

Upon articulation, panels 106, 108, 112, 116 are folded along fold lines 110, 114, 118, and closure flap 152 may be adhered to at least one of inner surface 102 and outer surface 104 of panel 116. Bottom panels 136, 140 may be folded towards inner surface 102 and bottom panels 138, 142 may be folded towards inner surface 102. Bottom panels 138, 142 may be adhered to outer surface 104 of bottom panels 136, 140 to form a bottom 156 of container 20. Preferably, top panels 120, 122, 124, 126 are left unfolded until items are placed within container 20. Container 20 may be closed by folding top panels 120, 124 towards inner surface 102 and folding top panels 122, 126 towards inner surface 102, wherein top panels 120, 124 may be adhered to outer surface 104 of top panels 122, 126 to form a top 158 of container 20.

When articulated or assembled, container 20 may have a width, depth and height forming an interior walled cavity configured to receive at least one insert subassembly 30 or insert 40, items and/or goods therein. In one embodiment, container 20 may have a width between about 6" and about 24", preferably between about 8" and about 14", and more preferably about 10", a length between about 6" and about 24", preferably between about 8" and about 14", and more preferably about 10", and a height between about 6" and about 24", preferably between about 8" and about 14", and more preferably about 10". In another embodiment, container 20 may be a cubed container. For example, container 20 may be 10" high, 10" wide, and 10" long. Alternatively, container 20 may have any size.

II. Insert Assembly or Subassembly 30

A. Blanks 160 and 162

Returning to FIG. 1, system 10 may include at least one insert subassembly 30. Subassembly 30 may include at least one insert 40 and at least one insulating pad 50 therein. In one embodiment, subassembly 30 includes two inserts 40 and 42, such as a bottom insert 40 and a top insert 42, wherein at least one insert 40 and 42 is configured to be inserted into container 20 and may abut interior surfaces 102 of panels 106, 108, 112, 116 of container 20. Inserts 40 and 42 may be configured fit together or interlock, such that inserts 40 and 42 may overlap and may be configured to and form a walled interior cavity to receive items or goods, such as temperature sensitive items, therein, and further are configured to prevent heat loss.

Figure 3:
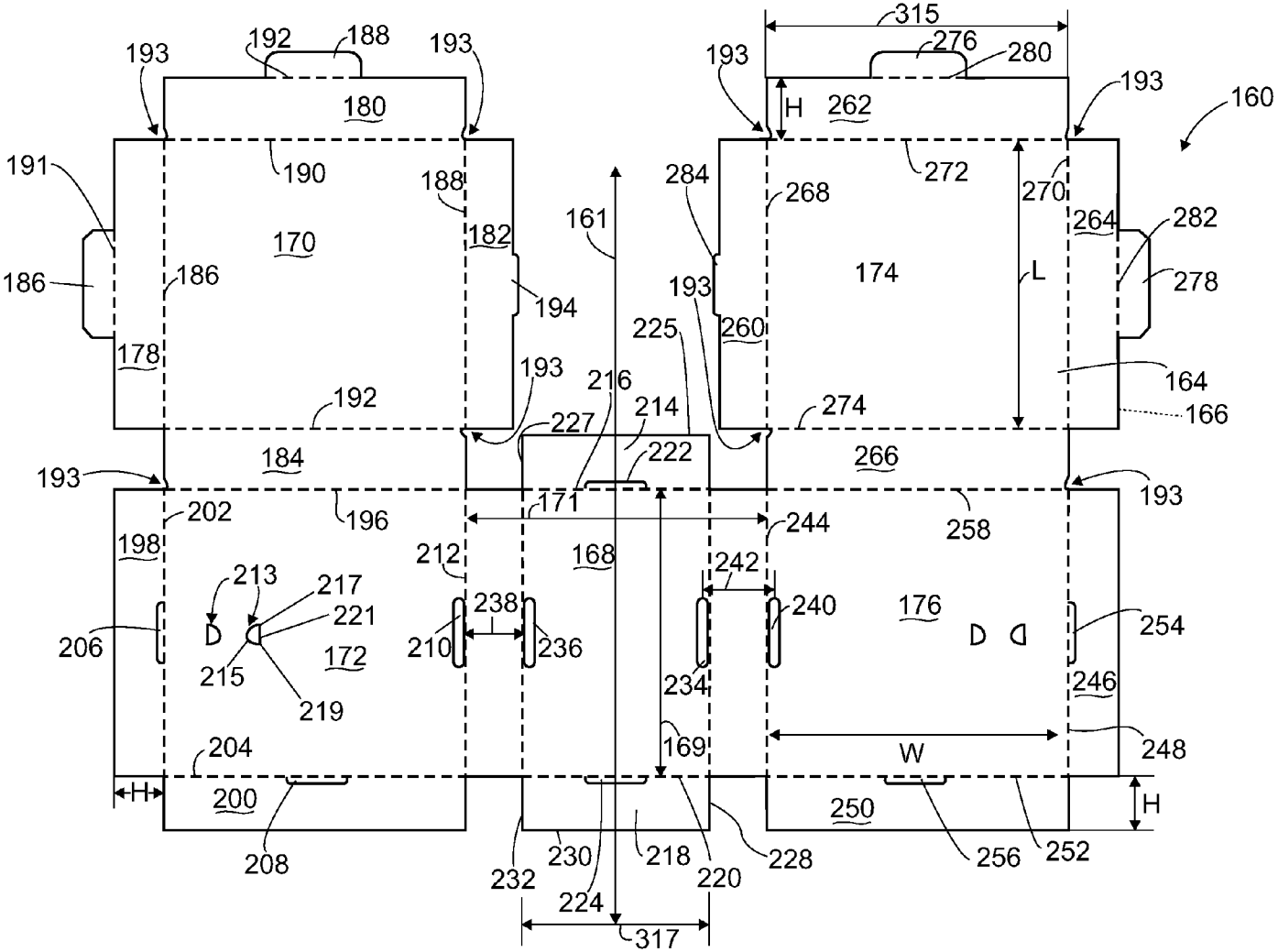
FIG. 3 is a plan view of a blank for forming a portion of a first insert according to the embodiment of FIG. 1.
Figure 4:
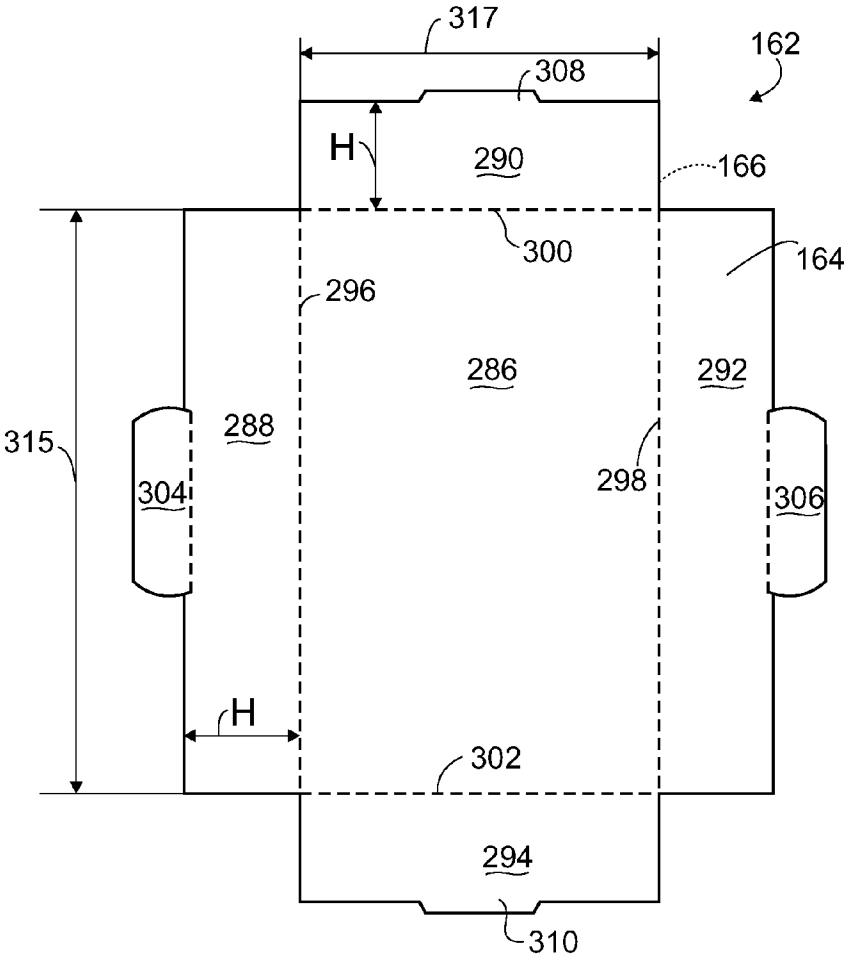
FIG. 4 is a plan view of a blank for forming another portion of a first insert according to the embodiment of FIG. 1.

Insert 40 may be formed from at least one blank. Turning to FIGS. 3 and 4, as described herein, in one embodiment, insert 40 may be assembled from blanks 160 and 162. Blank 160 having an inner surface 164 and an outer surface 166 and may include a plurality of panels. For example, blank 160 may include a center panel or center bottom panel 168, a first top panel 170, a first bottom panel 172, a second top panel 174 and a second bottom panel 176.

In one embodiment, blank 160 may be substantially symmetrical around an axis 161, as shown in FIG. 3. Moreover, panels 170, 172, 174, 176 may be substantially the same size having a length L and a width W. In one embodiment, as shown in FIG. 3, length L is defined between opposing lines of weakness, such as score lines or fold lines, and width W is defined between opposing lines of weakness, such as score lines or fold lines. For example, length L of panels 170, 172, 174, 176 may be between about 2" and about 20", preferably between about 6" and about 12", and more preferably about 9.75", and width W of panels 170, 172, 174, 176 may be between about 2" and about 20", preferably between about 6" and about 12", and more preferably about 9.75". Alternatively, panels 170, 172, 174, 176 may have any size and may have different sizes with respect to one another.

In one embodiment, a plurality of flaps 178, 180, 182, 184 emanate from first top panel 170. In one embodiment, flaps 178, 180, 182, 184 may facilitate forming a walled cavity to receive an insulating pad 50 therein.

Specifically, flaps 178, 182 may be opposed to one another and may extend from first top panel 170 along lines of weakness 186, 188, respectively, and flaps 180, 184 may be opposed to one another and may extend from first top panel 170 along fold lines 190, 192, respectively. Fold line 192 may be a top edge or a top fold line. First top panel 170 and flaps 178, 180, 182, 184 may have a substantially rectangular shape or any other suitable shape and/or size. Moreover, each flap 178, 180, 182, 184 may extend along the length of lines 186, 188, 190, 192, respectively.

Additionally, each flap 178, 180 may have at least one flange 186, 188 emanating from fold lines 191, 192, respectively. Each flange 186, 188 may have any suitable shape and/or size to engage a slot of blank 160. In one embodiment, at least one edge of flange 186, 188 is arcuate to facilitate inserting flange 186, 188 into a slot of blank 160.

Moreover, flap 182 may include a tab 194 emanating therefrom. In one embodiment, tab 194 is intended to remain substantially planar with flap 182, such that tab 194 does not bend or rotate with respect to flap 182. Tab 194 may have any suitable shape and/or size to engage a slot of blank 160. For example, tab 194 may have a substantially trapezoidal shape.

Also, blank 160 may include at least one indentation 193 to ease folding and assembly of blank 160. As shown in FIG. 3, an indentation 193 is defined proximate the intersection of score line 186 and fold line 190, another indentation 193 is defined proximate the intersection of score line 188 and fold line 190, and yet another indentation 193 is defined proximate the intersection of score line 188 and fold line 192.

First bottom panel 172 may emanate from flap 184 along a fold line or a top edge 196. At least one flap may emanate from panel 172. In one embodiment, flap 198 emanates from first bottom panel 172 along a score line 202, and a flap 200 emanates from first bottom panel 172 along a fold line 204. In one embodiment, score line 202 may be substantially parallel to score line 186, but may be offset a distance to ease folding of blank 160. For example, the offset distance may be substantially the same as the thickness of blank 160. Panel 172 and flaps 198, 200 may be substantially rectangular shape or any other suitable shape and/or size. Moreover, each flap 198, 200 may extend along the length of lines 202, 204, respectively.

At least one notch 206 may be formed within flap 198, proximate and/or along score line 202, and at least one notch 208 may be formed within flap 200 proximate and/or along fold line 204. Notches 206, 208 are sized to receive flanges 186, 188, respectively, therein. In one embodiment, notches 206, 208 may be formed in flaps 198, 200, respectively, along and/or adjacent to lines 202, 204, respectively.

In one embodiment, notches 206, 208 may be stamped in blank 160. This may increase the surface area of the blank and improve the strength of the engagement between flanges 178, 180 and notches 206, 208, respectively, when flanges are inserted into the notches. Notches 206, 208 may be a singular cut, including offsets, may be implemented thereby eliminating a need to remove waste material.

First bottom panel 172 further may include a slot 210 defined therein along a score line or side edge 212, and slot 210 may be configured to receive tab 194 therein. In one embodiment, slot 210 has at least one edge that is substantially collinear with line 212.

In one embodiment, score line 212 may be substantially parallel to score line 188, but may be offset a distance to ease folding of blank 160. For example, the offset distance may be substantially the same as the thickness of blank 160. Preferably, each notch 206, 208 and slot 210 is centered between ends of score line 202, fold line 204, score line 212, respectively.

Also, as shown in FIG. 3, an indentation 193 is defined proximate the intersection of score line 202 and fold line 196.

Moreover, at least two finger tabs 213 may be formed within panel 172. Each tab 213 may include a radial separation line 215 having a first end 217 and a second end 219, and a fold line 221 formed between ends 217 and 219. Each tab 213 is sized to receive a finger therein such that a user may easily insert at least finger into tab 213 to facilitate moving panel 172 and/or blank 160 with respect to the other panels of insert 40.

Center panel or bottom center panel 168 may emanate from panel 172 along score line 212. In one embodiment, length 169 of center panel 168 is defined between line 216 and line 220 and width 171 is defined between lines 212 and 244. For example, length 169 of panel 168 may be between about 2" and about 20", preferably between about 6" and about 12", and more preferably about 9.75", and width 171 of panel 168 may be between about 2" and about 20", preferably between about 6" and about 12", and more preferably about 9.75".

At least one flap may emanate from panel 168. In one embodiment, flap 214 emanates from panel 168 along a fold line 216, and a notch 222 is formed within flap 214 proximate and/or along fold line 216. Preferably, notch 222 is centered between ends of fold line 216. In one embodiment, notch 222 may be stamped in blank 160 such that no material is removed from blank 160 near notch 222. This may increase the surface area of the blank and improve the strength of the engagement between tab 308 and notch 222, when the tab is inserted into the notch.

Additionally, in one embodiment, flap 218 emanates from panel 168 along a fold line 220, and a notch 224 is formed within flap 218 proximate and/or along fold line 220. Preferably, notch 224 is centered between ends of fold line 220. In one embodiment, notch 224 may be stamped in blank 160 such that no material is removed from blank 160 near notch 224. This may increase the surface area of the blank and improve the strength of the engagement between tab 310 and notch 224, when the tab is inserted into the notch. Notches 222, 224 may be a singular cut, including offsets, may be implemented thereby eliminating a need to remove waste material.

Additionally, flap 214 may include a plurality of edges 223, 225, 227, wherein when blank 160 is in an unarticulated position, edge 223 may be substantially perpendicular to fold line 216, edge 223 may be substantially perpendicular to edge 225, and edge 227 may be substantially perpendicular to both edge 225 and fold line 216. Similarly, flap 218 may include a plurality of edges 228, 230, 232, wherein when blank 160 is in an unarticulated position, edge 228 may be substantially perpendicular to fold line 220, edge 230 may be substantially perpendicular to edge 228, and edge 232 may be substantially perpendicular to both edge 230 and fold line 220.

When blank 160 is in an unarticulated position, a slot 234 may by defined within panel 168 along a line substantially collinear with edges 223 and 228. Similarly, when blank 160 is in an unarticulated position, a slot 236 may be defined within panel 168 along a line substantially collinear with edges 226 and 232. In one embodiment, slot 236 may be defined a distance 238 from slot 210, and slot 236 may be defined a distance 242 from a slot 240 defined within second bottom panel 176. In one embodiment, distance 238 is substantially similar in size to the width of flap 182 and/or the thickness of at least one insulating pad 50. In one embodiment, distance 242 is substantially similar in size to the width of flap 260 and/or the thickness of at least one insulating pad 50.

Second bottom panel 176 may emanate from panel 168 along a score line or side edge 244, and at least one flap may emanate from panel 176. In one embodiment, flap 246 emanates from panel 176 along a score line 248, and a flap 250 emanates from panel 176 along a fold line 252. Panel 176 and flaps 246, 250 may be substantially rectangular shape or any other suitable shape and/or size. Moreover, each flap 246, 250 may extend along the length of lines 248, 252, respectively.

At least one notch 254 may be formed within flap 248 proximate and/or along score line 248, and at least one notch 256 may be formed within flap 250 proximate and/or along fold line 252. Notches 254, 256 are sized to receive flanges therein. In one embodiment, notches 254, 256 may be formed in flaps 246, 250, respectively, along and/or adjacent lines 248, 252, respectively. Also, in one embodiment, notches 254, 256 may be stamped in blank 160 such that no material is removed from blank 160 near notches 254, 256. This may increase the surface area of the blank and improve the strength of the engagement between flanges 276 and 278 and notches 256, 254, respectively, when flanges are inserted into the notches. Notches 254, 256 may be a singular cut, including offsets, may be implemented thereby eliminating a need to remove waste material.

Panel 176 further may include slot 240 defined therein along score line 244, and slot 240 may be configured to receive a tab therein. In one embodiment, slot 240 has at least one edge that is substantially collinear with line 244. Preferably, each slot 240 and each notch 254, 256 is centered between ends of score line 244, fold line 252, score line 252, respectively. As an alternative, rather than the designated and created slot 240, a singular cut, such as a notch, including offsets as required may be implemented thereby eliminating a need to remove waste material.

Also, as shown in FIG. 3, an indentation 193 is defined proximate the intersection of score line 248 and a fold line or top edge 258.

Moreover, at least two finger tabs 213 may be formed within panel 172. Each cut 213 may include a radial separation line 215 having a first end 217 and a second end 219, and a fold line 221 formed between ends 217 and 219. Each tab 213 is sized to receive a finger therein such that a user may easily insert at least finger into tab 213 to facilitate moving panel 176 and/or blank 160.

In one embodiment, a plurality of flaps 260, 262, 264, 266 emanate from second top panel 174. Specifically, flap 266 emanates from fold line 258. In one embodiment, flaps 260, 262, 264, 266 may facilitate forming a walled cavity to receive an insulating pad 50 therein.

Specifically, flaps 260, 264 may be opposed to one another and may extend from panel 174 along score lines 268, 270, respectively, and flaps 262, 266 may be opposed to one another and may extend from panel 174 along fold lines 272, 274, respectively. Fold line 274 may be a top fold line or top edge. Panel 174 and flaps 260, 264, 262, 266 may have a substantially rectangular shape or any other suitable shape and/or size. Moreover, each flap 260, 264, 262, 266 may extend along the length of lines 268, 270, 272, 274, respectively.

Additionally, each flap 262, 264 may have at least one flange 276, 278 emanating from flap 262, 264 along fold lines 280, 282, respectively. Each flange 276, 278 may have any suitable shape and/or size to engage a slot of blank 160.

Moreover, flap 260 may include a tab 284 emanating therefrom. In one embodiment, tab 284 is intended to remain substantially planar with flap 260, such that tab 284 does not bend or rotate with respect to flap 260. Flap 260 may have any suitable shape and/or size to engage a slot of blank 160. For example, flap 260 may have a substantially trapezoidal shape.

As shown in FIG. 3, an indentation 193 is defined proximate the intersection of score line 268 and fold line 272, another indentation 193 is defined proximate the intersection of score line 270 and fold line 272, and yet another indentation 193 is defined proximate the intersection of score line 270 and fold line 274.

Turning to FIG. 4, as described herein, insert 40 may be assembled from blanks 160 and 162. Blank 162 has an inner surface 164 and an outer surface 166 and that may include at least one panel.

Blank 162 may include a top center panel 286. In one embodiment, a plurality of flaps 288, 290, 292, 294 emanate from first top panel 170. In one embodiment, flaps 288, 290, 292, 294 may facilitate forming a walled cavity to receive an insulating panel 50 therein.

Specifically, flaps 288, 292 may be opposed to one another and may extend from panel 286 along fold lines 296, 298, respectively, and flaps 290, 294 may be opposed to one another and may extend from panel 286 along fold lines 300, 302, respectively. Panel 286 and flaps 288, 290, 292, 294 may have a substantially rectangular shape or any other suitable shape and/or size. Moreover, each flap 288, 290, 292, 294 may extend along the length of lines 296, 300, 298, 302, respectively.

Additionally, each flap 288, 292 may have at least one flange 304, 306 emanating from fold lines. Each flange 304, 306 may have any suitable shape and/or size to engage a slot of blank 160. In one embodiment, at least one edge of flange 304, 306 is arcuate to facilitate inserting flange 304, 306 into a slot of blank 160. Alternatively, each element 304, 306 may be a tab, similar to tabs 308 and 310, rather than flanges (for an example, see elements 304', 306' of FIG. 11). In a further alternative, each element 304, 306 may have any fastener, with any suitable shape and/or size, to facilitate coupling blanks 310 and 312 together.

Moreover, flap 290 may include a tab 308 emanating therefrom. In one embodiment, tab 308 is intended to remain substantially planar with flap 290, such that tab 308 does not bend or rotate with respect to flap 290. Tab 308 may have any suitable shape and/or size to engage a slot of blank 160, such as a substantially trapezoidal shape.

Similarly, flap 294 may include a tab 310 emanating therefrom. In one embodiment, tab 310 is intended to remain substantially planar with flap 294, such that tab 310 does not bend or rotate with respect to flap 294. Tab 310 may have any suitable shape and/or size to engage a slot of blank 160, such as a substantially trapezoidal shape.

Figure 11:
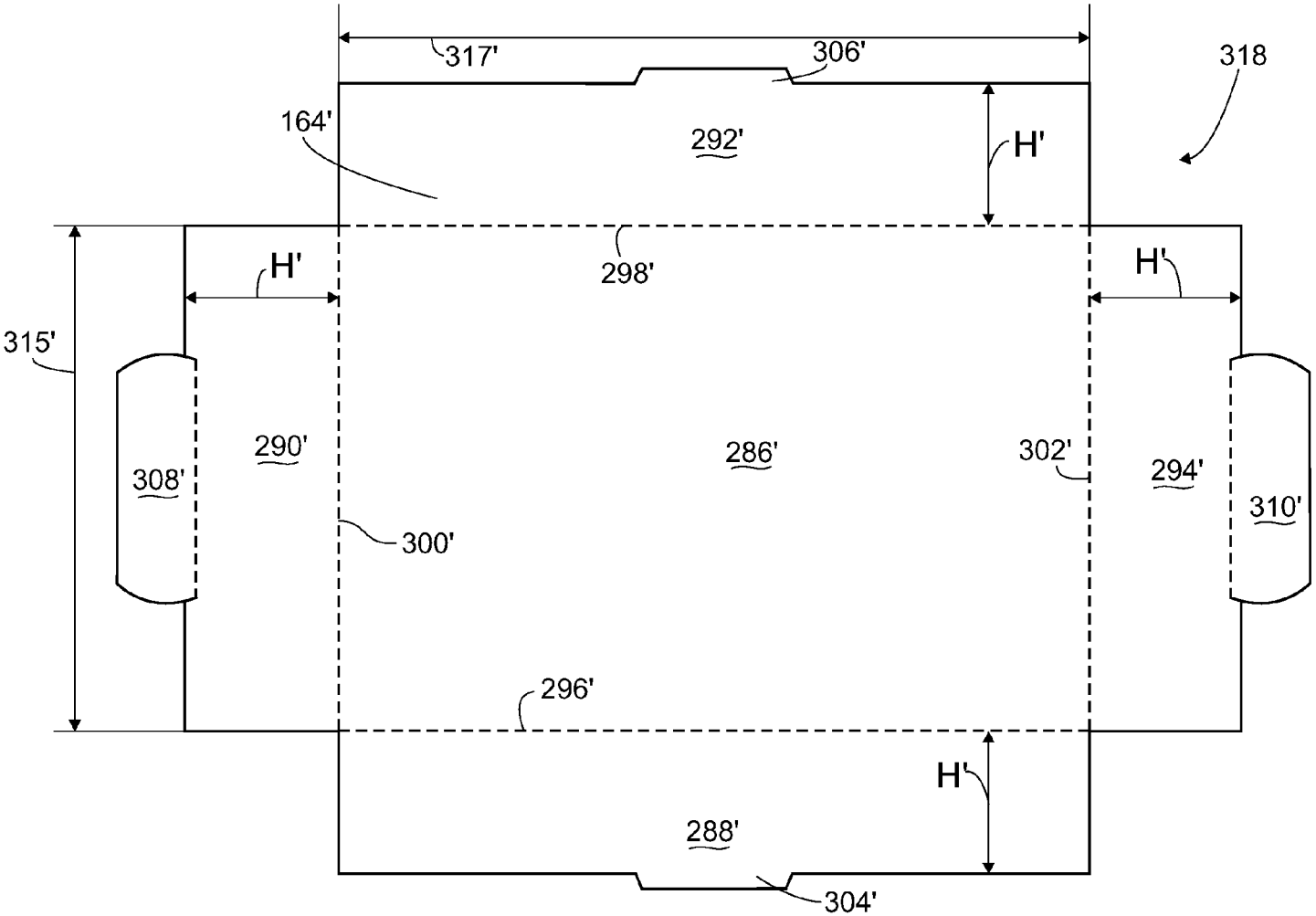
FIG. 11 is a plan view of a blank for forming another portion of a second insert according to the embodiment of FIG. 1.

Alternatively, tabs 308, 310 may be flanges, similar to flanges 304, 306, rather than tabs (for an example, see elements 308', 310' of FIG. 11). In a further alternative, each element 308, 310 may have any fastener, with any suitable shape and/or size, to facilitate coupling blanks 310 and 312 together.

In one embodiment, flaps 178, 180, 182, 184, 198, 200, 214, 218, 260, 262, 264, 266, 246, 250, 288, 290, 292, 294 have a substantially similar height H, such that the height is substantially the same as the thickness of the insulating pads 50. Moreover, in one embodiment, flaps 178, 180, 182, 184, 198, 200, 260, 262, 264, 266, 246, 250, 288, 292 have a substantially similar length 315. For example, the flap length of flaps 178, 180, 182, 184, 198, 200, 260, 262, 264, 266, 246, 250, 288, 292 may be between about 2" and about 20", preferably between about 6" and about 12", and more preferably about 9.75". Also, in one embodiment, the flap length 317 of flaps 214, 218, 290, 294 may be between about 2" and about 20", preferably between about 6" and about 12", and more preferably about 9.75". As described, flap length 317 may be less than flap length 315. Alternatively, all flaps of blanks 160 and 162 may have any height and length, and each flap may have a different height and length than the other flaps of the blanks.

B. Insulation Pad(s) 50

Figure 5:
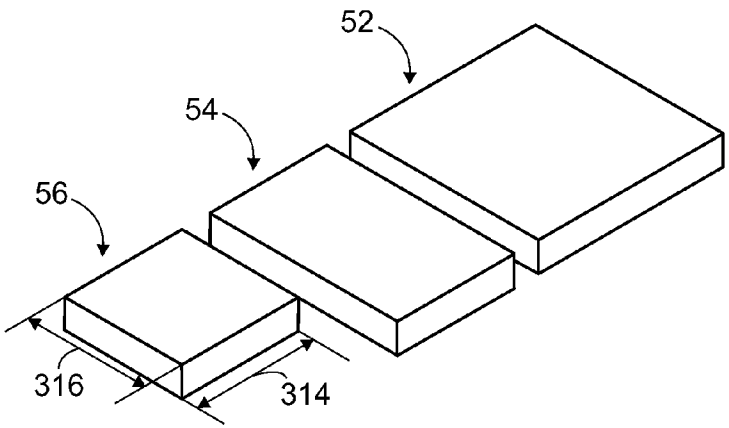
FIG. 5 is a perspective view of a plurality of insulation pads for use with the container of FIG. 1.

Turning to FIG. 5, insert subassembly 30 may include at least one insulating or insulation pad 50. Insulating pad 50 may be a cellulose insulating pad configured to provide thermal insulation and/or shock absorption. Pad 50 may be manufactured using primarily post consumer recycled (PCR) content, such as newsprint and other lightweight recycled papers, i.e., cellulose. Each pad 50 may be have between about 70% and 95% PCR content by weight, specifically between about 75% and about 85% PCR content by weight, and preferably about 80% PCR content by weight. The remaining material may be a binding material or agent, such as polyester, polypropylene, and/or polyethylene. Additionally, paper has a highly efficient insulator with R values equal to or better than foam-based containers. For example, pad 50 may have a thickness of about 1" and may have an R value between about 3.5 and about 3.7.

Additionally, subassembly 30 may include a plurality of pads with different shapes and sizes. In one embodiment, subassembly 30 may include a total of six pads 50, wherein each pad 50 is substantially rectangular and has a thickness. The thickness may be between about 0.2" and about 2", preferably between about 0.5" and about 1.5", and more preferably about 1". Also in one embodiment, each pad 50 may be sized to be positioned adjacent to at least one panel of at least one blank 160 and/or a blank 312.

Pads are configured to be inserted into a walled cavity formed by the panels, flaps, flanges and/or tabs of at least one blank 160 and/or 312. Therefore, each pad 50 may have a size, i.e., width 314 and height 316, which is substantially the same size of at least one corresponding panel. For example, as shown in FIG. 5, three pads 52, 54, 56 are of varying size, such that pad 52 is sized to correspond to the size of panels 170, 172, 174, and/or 176, and pad 54 is sized to correspond to panel 168 and/or 286 and to panels of blanks 312 and 318, and pad 56 is sized to correspond to the size of panels of blanks 312 and 318. In one embodiment, pad 52 may be substantially square and may have a height 316 of about 9.5" and a width 314 of about 9.5", pad 54 may be substantially rectangular have a height 316 of about 9.5" and a width 314 of about 7", and pad 56 may be substantially square and have a height 316 of about 7" and a width 314 of about 7".

C. Articulation of Insert 40

Insert 40 may be formed from at least one blank. Turning to FIGS. 6-9, as described herein, insert 40 may be assembled from blanks 160 and 162, such that blanks 160 and 162 may be articulated and coupled together.

In one embodiment, first top panel 170, flaps 178, 180, 182, 184, first bottom panel 172, and/or flaps 198, 200 form a first walled cavity 320 of insert 40. Similarly, in one embodiment, second top panel 170, flaps 260, 262, 264, 266, second bottom panel 172, and/or flaps 246, 250 form a second walled cavity 322 of insert 40. Moreover, in one embodiment, center top panel 286, flaps 288, 290, 292, 294, bottom center panel 168, and/or flaps 214, 218 form a third walled cavity 324.

Figure 6:
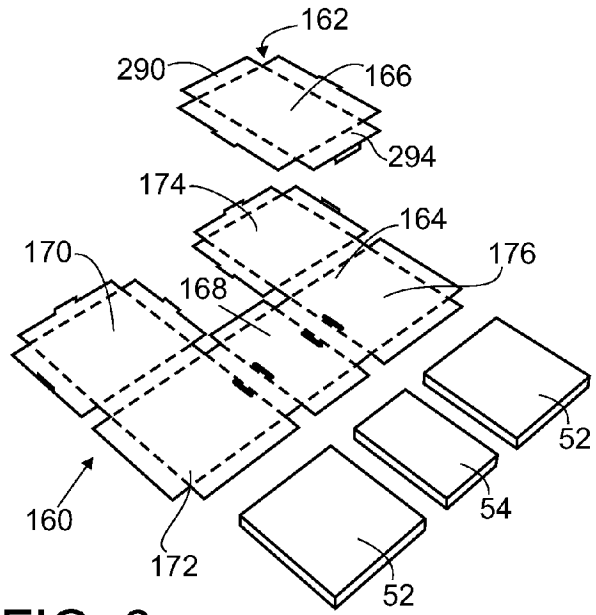
FIG. 6 is a perspective view of the blanks of FIGS. 3 and 4, in an exploded configuration, at an early stage in the process of being articulated into a first insert, with the goods to be packaged being omitted from the illustration.

In a typical articulation procedure, as shown sequentially in FIGS. 6-9, first, the insulating pads 52, 54 and/or 56 to be contained within respective walled cavities 320, 322 and/or 324 may be positioned in front of blank 160, as shown in FIG. 6.

Second, blank 160 may be laid flat on a packaging apparatus or on a substantially planar surface, such as a table or the ground.

Third, flaps 288, 290, 292, 294 may be folded substantially perpendicular to panel 286, such that in one embodiment, the flaps may be folded towards inner surface 164. Flaps 288, 290, 292, 294 may be folded downwardly perpendicularly to panel 286.

Figure 7:
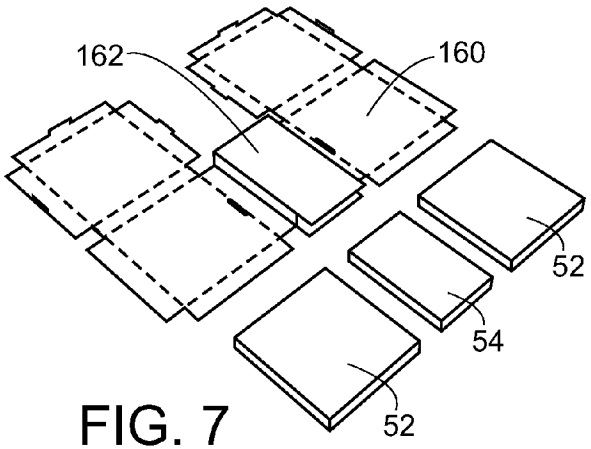
FIG. 7 is a perspective view of the blanks of FIGS. 3 and 4 and insulation pad of FIG. 5, in an exploded configuration, at a later stage in the process of being articulated into a first insert, with the goods to be packaged being omitted from the illustration.
Figure 9:
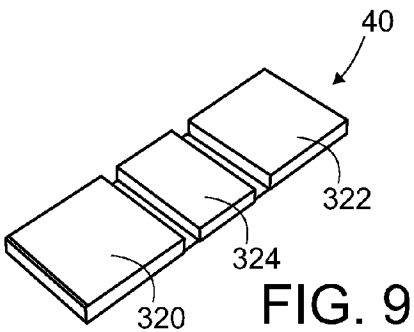
FIG. 9 is a perspective view of a first insert of FIG. 1 in a closed position.

Fourth, tab 308 may be inserted into slot 222 and/or flaps 304, 306 may be inserted into slots 236, 234, respectively, such that, as shown in FIG. 7, blanks 160, 162 are coupled together to form a partially walled cavity. Outer surfaces 166 of flaps 290, 294 preferably are adjacent and/or in in contact with inner surfaces 164 of flaps 214, 218, respectively.

Fifth, flaps 178, 180, 182 may be folded substantially perpendicular to panel 170, such that in one embodiment, the flaps may be folded towards inner surface 164. Similarly, flaps 198, 200 may be folded substantially perpendicular to panel 172, such that in one embodiment, the flaps may be folded towards inner surface 164. Further, flaps 260, 262, 264 may be folded substantially perpendicular to panel 174, such that in one embodiment, the flaps may be folded towards inner surface 164. Similarly, flaps 246, 250 may be folded substantially perpendicular to panel 176, such that in one embodiment, the flaps may be folded towards inner surface 164. In such an embodiment, outer surface 166 of flap 198 preferably is adjacent and/or is in contact with inner surface 164 of flap 178, and outer surface 166 of flap 246 preferably is adjacent and/or in in contact with inner surface 164 of flap 264.

Figure 8:
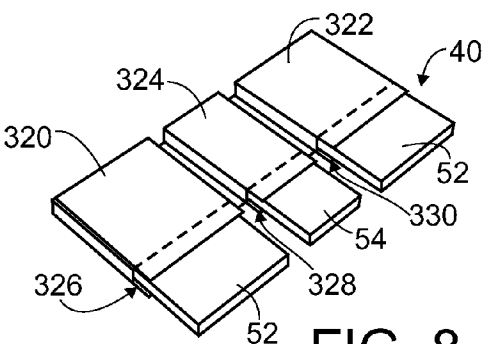
FIG. 8 is a perspective view of the blanks of FIGS. 3 and 4 and insulation pad of FIG. 5, near the end of the process of articulation into a completed first insert, prior to closure of the insert, with the goods to be packaged being omitted from the illustration.

Sixth, first top panel 170 may be rotated towards inner surface 164 along at least one of fold lines 192, 196, such that tab 194 may be inserted into slot 210 and/or flanges 186 may be rotated and inserted into notch 206. As shown in FIG. 8, panels 170, 172 together form a walled cavity 320. Similarly, second top panel 174 may be rotated towards inner surface 164 along at least one of fold lines 258, 274, such that tab 284 may be inserted into slot 240 and flange 278 may be rotated and/or inserted into slot 254. As shown in FIG. 8, panels 174, 176 together form a walled cavity 322. Indentations 193 provide ease assembly of cavities 320, 322, 324, such that indentations 193 substantially prevent interference between adjacent or non-adjacent panels, flanges, tabs and/or flaps.

Seventh, as shown in FIG. 8, insulating pads are inserted into walled cavities. For example, insulating pads 52, 54, 56 are inserted into cavities 320, 324, 322, respectively, through open ends 326, 328, 330 proximate flaps 200, 218, 250, respectively.

Eighth, flap 200 may be folded upwardly and substantially perpendicular to panel 172, flap 180 then may be folded downwardly and substantially perpendicular to panel 170, and flange 188 may be rotated and/or inserted into notch 208 to close walled cavity 320. Flap 218 may be folded upwardly and substantially perpendicular to panel 168, flap 294 then may be folded downwardly and substantially perpendicular to panel 286, and tab 310 may be inserted into notch 224 to close walled cavity 324. Flap 250 may be folded upwardly and substantially perpendicular to panel 176, flap 262 then may be folded downwardly and substantially perpendicular to panel 174, and flange 276 may be rotated and/or inserted into notch 256 to close walled cavity 322.

As described herein, no adhering material needed or used to assembly insert 40 having walled cavities 320, 324, 322.

In an alternative sequence, insulating pads 50 may be placed on inner surface 164 of panels 172, 168, 164, respectively, prior to articulation of blanks 160 and 162, rather than being inserted into the walled cavities after articulation of blanks 160 and 162.

D. Blanks 312 and 318

Figure 10:
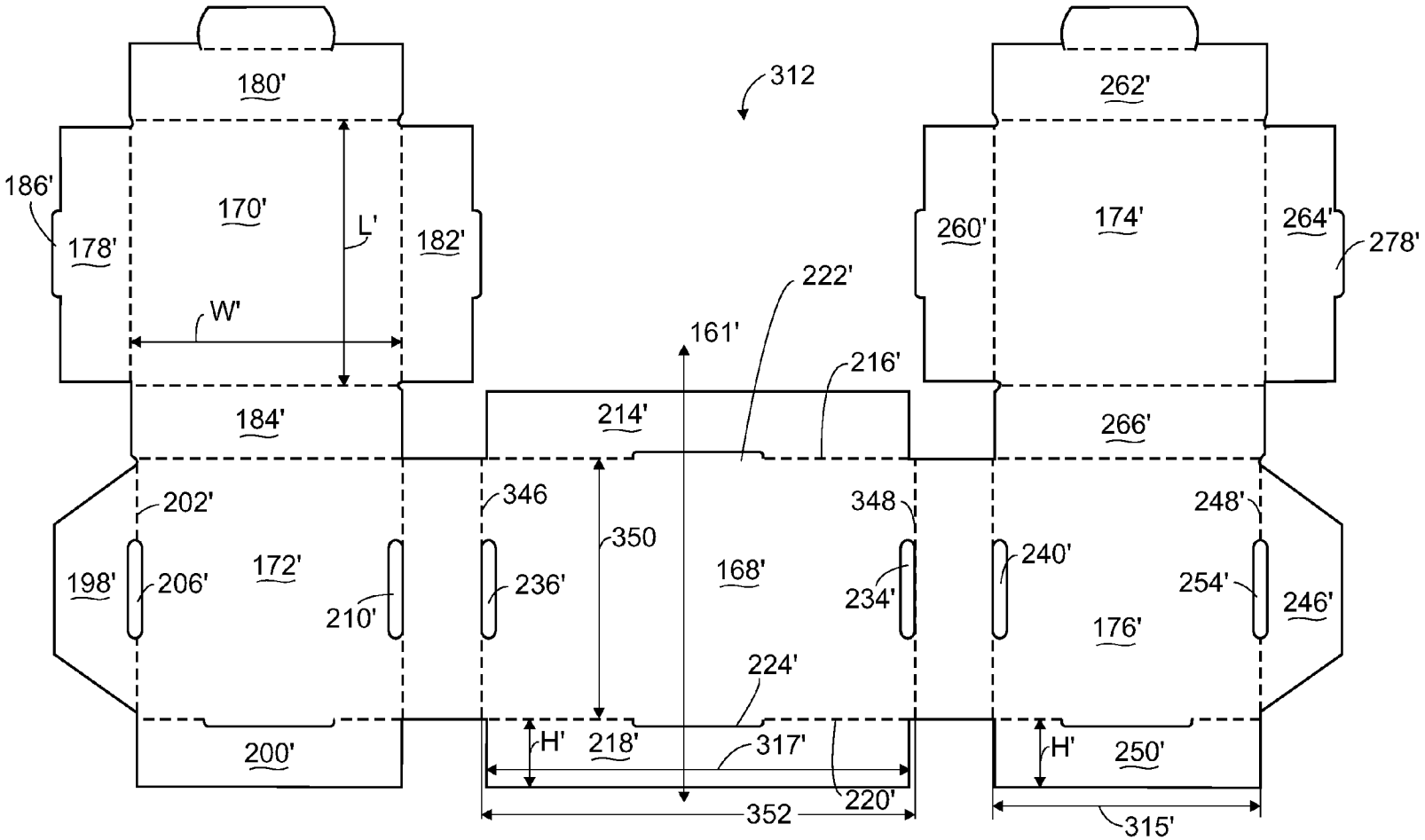
FIG. 10 is a plan view of a blank for forming a portion of a second insert according to the embodiment of FIG. 1.

Subassembly 30 further may include an insert 42. Insert 42 may be formed from at least one blank. Turning to FIGS. 10 and 11, as described herein, insert 42 may be assembled from blanks 312 and 318.

Blank 312 (FIG. 10) is substantially the same as that of blank 160 (FIG. 3). Therefore, the panels, notches, slots, flanges, tabs, flaps and/or lines of weakness, i.e., fold and/or score lines forming blank 312 which are similar or identical to corresponding panels, notches, slots, flanges, tabs, flaps and/or lines of weakness, i.e., fold and/or score lines of blank 312 are provided with like reference numerals, augmented by a prime (').

Blank 312 (FIG. 10) is substantially the same as that of blank 160 (FIG. 3), except that the flaps 198', 246' may be trapezoidal, as compared to flaps 198, 246 which may be rectangular. Further, elements 186', 278' may be tabs rather than flanges 186, 278. Also, elements 206', 254' may be slots, rather than notches 206, 254. Elements 206', 254' may be configured to receive tabs 186' and 278', respectively, therein.

Also, blank 312 may include lines of weakness 346, 348. Lines of weakness 346, 348 may be side edges of center panel 168'. In blank 312, slot 236' may be defined along line of weakness 346, and slot 236' may be configured to receive a tab or flange therein, preferably a tab or flange of blank 318. In one embodiment, slot 236' has at least one edge that is substantially collinear with line 346. Preferably, slot 240 is centered between ends of line 346. Similarly, in blank 312, slot 234' may be defined along line of weakness 348, and slot 234' may be configured to receive a tab or flange therein, preferably a tab or flange of blank 318. In one embodiment, slot 234' has at least one edge that is substantially collinear with line 348. Preferably, slot 234' is centered between ends of line 348.

Additionally, as shown in FIG. 10, blank 312 may include lines of weakness 202', 248'. Alternatively, blank 312 may not include lines of weakness 202', 248', such that flaps 198', 246' are configured to remain substantially coplanar with panels 172', 176', respectively, and flaps 198', 246' would not be configured to rotate, so that flaps 198', 246' of blank 312 may be configured to engage at least one wall 320, 322, 324 of insert 40 when inserts 40 and 42 are coupled together.

Further, in one embodiment, blank 312 may be substantially symmetrical around an axis 161', as shown in FIG. 10.

Moreover, panels 170', 172', 174', 176' may be substantially the same size as one another having a length L' and a width W'. In one embodiment, as shown in FIG. 10, length L' is defined between opposing lines of weakness, such as score lines or fold lines, and width W' is defined between opposing lines of weakness, such as score lines or fold lines. For example, length L' of panels 170', 172', 174', 176' may be between about 2" and about 20", preferably between about 6" and about 12", and more preferably about 7", and width W' of panels 170', 172', 174', 176' may be between about 2" and about 20", preferably between about 6" and about 12", and more preferably about 7". Alternatively, panels 170', 172', 174', 176' may have any size and may have different sizes with respect to one another.

In one embodiment, length 350 of center panel 168' is between line 216' and line 220' and width 352 is between lines 346 and 348. For example, length 350 of panel 168' may be between about 2" and about 20", preferably between about 6" and about 12", and more preferably about 7", and width 352 of panel 168' may be between about 2" and about 20", preferably between about 6" and about 12", and more preferably about 9.75".

Turning to FIG. 11, blank 318 (FIG. 11) is substantially the same as that of blank 162 (FIG. 4). Therefore, the panels, slots, flanges, tabs, flaps and/or lines of weakness, i.e., fold and/or score lines forming blank 318 which are similar or identical to corresponding panels, slots, flanges, tabs, flaps and/or lines of weakness, i.e., fold and/or score lines of blank 318 are provided with like reference numerals, augmented by a prime (').

Blank 318 is substantially the same as that of blank 162 (FIG. 4), except that elements 308', 310' may be flanges rather than tabs 308, 310. Also, elements 304', 306' may be flanges, rather than tabs 304, 306. Elements 236', 234' may be configured to receive tabs 308', 310', respectively, therein, and elements 222', 224' may be configured to receive 304', 306', respectively, therein.

In one embodiment, flaps 178', 180', 182', 184', 198', 200', 214', 218', 260', 262', 264', 266', 246', 250', 288', 290', 292', 294' have a substantially similar height H', such that the height is substantially the same as the thickness of the insulating pads 50. Moreover, in one embodiment, flaps 178', 180', 182', 184', 198', 200', 260', 262', 264', 266', 246', 250', 290', 294' have a substantially similar length 315'. For example, the length 315' may be between about 2" and about 20", preferably between about 6" and about 12", and more preferably about 7". Also, in one embodiment, flap length 317' of flaps 214', 218', 288', 292' may be between about 2" and about 20", preferably between about 6" and about 12", and more preferably about 9.75". As described, flap length 317' may be greater than the flap length 315'. Alternatively, all flaps of blanks 312 and 318 may have any height and length, and each flap may have a different height and length than the other flaps of the blanks E. Articulation of Insert 42

Accordingly, blanks 310 and 312 may be articulated and coupled together to form insert 42, and the method of articulation of blanks 312 and 318 are substantially the same to the method of articulation of blanks 160 and 162 (FIGS. 6-9); however, the articulation of blank 312 does not include either rotating or folding flaps 198', 200' substantially perpendicular to panel 172' or rotating or folding flaps 246', 250' substantially perpendicular to panel 174'. Rather, during articulation of blank 312, flaps 198', 200' may remain substantially coplanar with panel 172', flap such that flaps 198', 200' may not be rotated, and flaps 246', 250' may remain substantially coplanar with panel 176', such that flaps 246', 250' may not be rotated. In this embodiment, flaps 198', 200', 246' and/or 250' are configured to engage and/or overlap with portions of insert 40, as described in further detail herein.

Moreover, in one embodiment, a difference between articulation of blanks 312 and 318 and articulation of blanks 160 and 162 is that when blank 318 is coupled to blank 312, flange 308' is inserted into slot 236', flange 310' is inserted into slot 234', tab 304' is inserted into tab 222', and to close the walled cavity 324', tab 304' is inserted into tab 224'.

G. Assembly of Inserts 40, 42

Figure 12B:
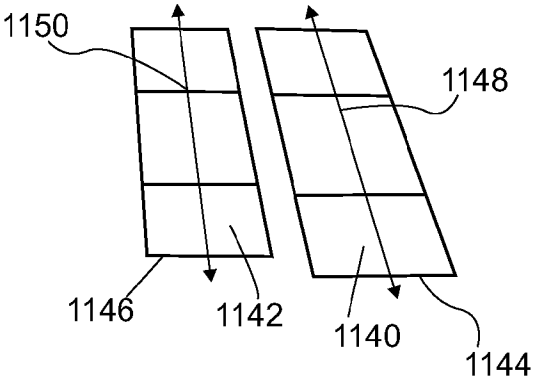
FIG. 12B is a perspective view of another embodiment of a first insert and a second insert in a closed position.
Figure 12A:
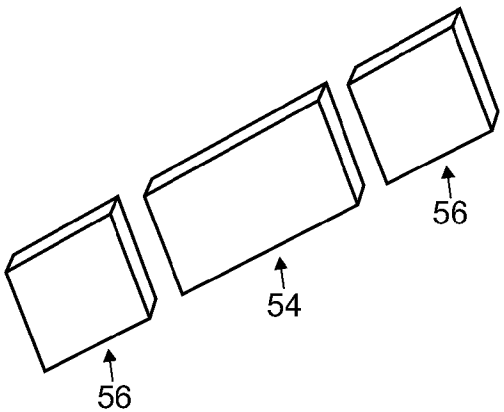
FIG. 12A is a perspective view of an arrangement of insulation pads of FIG. 5.
Figure 12:
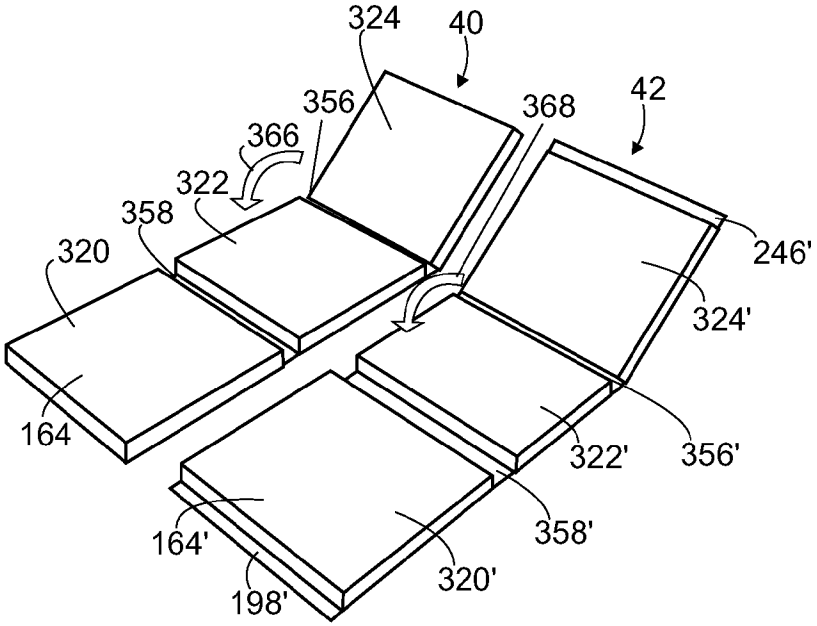
FIG. 12 is a perspective view of a first insert of FIG. 1 in a closed position and the second insert in a closed position.

Turning to FIG. 12, each assembled insert 40 and 42 may be configured to rotate along lines of weakness towards inner surface 164, 164', respectively, to create a C-shape. As insert 40 is rotated into a C-shape shape in a direction 366, a side of walled cavity 324 may fit within a folding area 356, between slots 234 and 240, and a side of walled cavity 322 may fit within a folding area 358, between slots 210 and 236. Similarly, as insert 42 is rotated into a C-shape in a direction 368, a side of walled cavity 324' may fit within a folding area 356', between slots 234' and 240', and a side of walled cavity 322' may fit within a folding area 358', between slots 210' and 236'.

Figure 13:
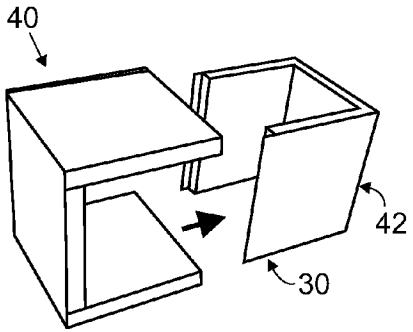
FIG. 13 is a perspective view of one embodiment of the first and second inserts, in an exploded configuration.
Figure 14:
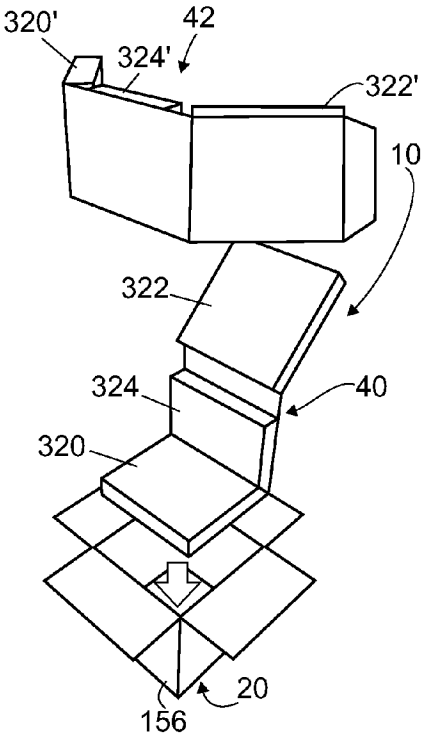
FIG. 14 is perspective view of the container of FIG. 1 and inserts of FIG. 12, in an exploded configuration, at an early stage in the process of being articulated into a system, with the goods to be packaged being omitted from the illustration.
Figure 15:
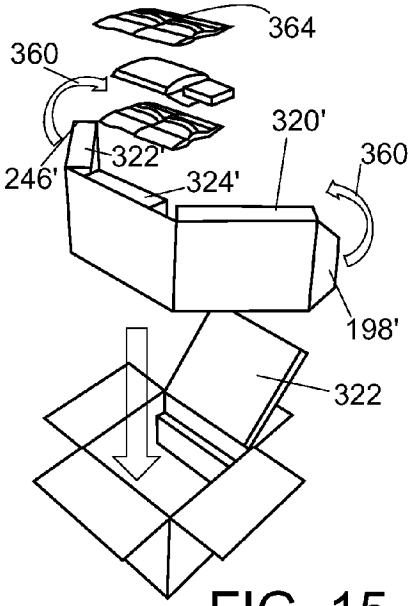
FIG. 15 is a perspective view of the container of FIG. 1 and inserts of FIG. 12, in an exploded configuration, at a later stage in the process of being articulated into a system.
Figure 16:
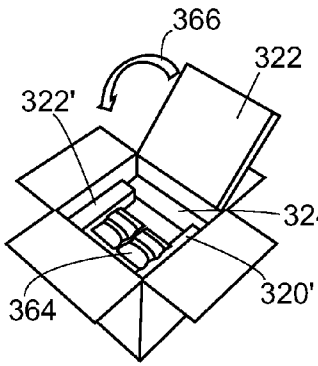
FIG. 16 is a perspective view of the container of FIG. 1 and inserts of FIG. 12, near the end of the process of articulation into a completed system, prior to closure of the system.

The two C-shaped inserts 40 and 42 are configured to fit together, i.e., interlock, to create a walled cavity 354, shown in FIG. 16, for receiving goods, such as temperature sensitive goods, therein. Specifically, as shown in FIG. 13, inserts 40, 42 are configured to have an interference fit, wherein the inserts 40, 42 fit tightly together. This snug or tight fit facilitates prevention of heat loss. Walled cavities of insert 40 are designed to contact walled cavities of insert 42 and flaps 198' and 246' are configured to engage portions of walled cavity 322 of insert 40.

Insert subassembly 30, with inserts 40, 42, may be inserted into a container 20.

H. Film Embodiment of Insert Subassembly 30

As shown in FIG. 12B, in an alternative embodiment, insert subassembly 30 may be comprised of an insert 1140 and 1142. In one embodiment, each insert 1140 and 1142 may be comprised of insulating pads 50 and a biodegradable material, such as a biodegradable film or paper.

Alternatively, each insert 1140 and 1142 may be comprised of insulating pads 50 and a heat sealable paper, wherein the pads and paper may be coupled together with adhesive bonding or a sealable coating.

Insert 1140 may be substantially similar to insert 40; however, insert 1140 includes biodegradable material, such as film, rather than paperboard blanks 160 and 162. Similarly, insert 1142 may be substantially similar to insert 42; however, insert 1142 includes biodegradable material, such as film, rather than paperboard blanks 312 and 318. In one embodiment, the biodegradable material, such as film, is compostable and is water and heat resistant.

As such, the method of articulation of inserts 1140, 1142 varies from articulation of inserts 40, 42. Specifically, to articulate inserts 1140 and 1142, in one embodiment, first, three insulating pads 50 are arranged as shown in FIG. 7, and second, a biodegradable material, such as film, is wrapped around the insulating pads and sealed at least one end 1144 to form insert 1140. The biodegradable material may be substantially taught around the pads while still enabling insert 1140 to be folded into a C-shape. Similarly, to articulate insert 1142, in one embodiment, first, three insulating pads 50 are arranged as shown in FIG. 12A, and second, biodegradable material, such as a sleeve of biodegradable film, is wrapped around the insulating pads and sealed at least one end 1146 to form insert 1142. The biodegradable material may be taught around the pads while still enabling insert 1142 to be folded into a C-shape. One of the differences between insert 1140 and 1142 is that insert 1140 may include insulating pads 52 and insert 1142 may include insulating pads 56. In one embodiment, insulating pads 56 may be smaller than insulating pads 52. Moreover, another difference between insert 1140 and 1142 is that insulating pad 54 of insert 1140 may be substantially perpendicular to an axis 1148 and insulating pad 54 of insert 1142 may be substantially parallel to an axis 1150 of insert 1142.

Inserts 1140, 1142 may fit together in a similar way to the way that inserts 40, 42 fit together, as shown in FIG. 13.

III. Assembly of System 10

Turning to FIGS. 14-17, system 10 may be assembled such that insert subassembly 30 may be inserted into container 20. Specifically, turning to FIG. 14, insert 40 is inserted into container 20 such that either walled cavity 320 or 322 is pushed towards bottom 156 until walled cavity 320 or 322 contacts or lines bottom 156. When walled cavity 320, 322 contacts bottom 156, panel 168 may contact or line a side panel 106, 108, 112, 116 of container 20, and the other walled cavity 320, 324 that is not lining the bottom is to contact at least one top panel 120, 122, 124, 126 of container 20. After insert 40 is inserted into container 20, insert 42 may be inserted into container 20 to come into contact with insert 40. Specifically, turning to FIG. 15, walled cavities 322', 320' may be rotated in a direction 360 towards one another until cavities 322', 320' contact walled cavity 324' and cannot be rotated any further, and then moving insert 42 in a downward direction towards insert 40 until inserts 40 and 42 contact one another. In one embodiment, flaps 198' and 246' engage at least two sides of walled cavity 324 of insert 40, and/or flaps 198', 246' may overlap with at least one side of walled cavity 324. The overlap may reduce heat loss. Also, in one embodiment, each walled cavity 320', 322', 324' may contact at least one respective side panel 106, 108, 112, 116 of container 20.

Inserts 40 and 42 define an insulated cavity 362, shown in FIG. 16, configured to receive goods 364 therein. Cavity 362 is enclosed but may be accessible. Inserts 40 and 42 are configured to keep goods 364 insulated. Goods 364 may include at least four 24 ounce frozen gel packs, 0.25" microfoam insulating pouch, and a temperature sensitive item. In one embodiment, a temperature sensitive item is placed in an insulating pouch, two gel packs are placed on top of the pouch, and two gel packs are placed below the pouch.

Once inserts 40 and 42 are inserted into container 20 and goods 364 are inserted into cavity 362, walled cavity 322 is rotated towards cavity 362 in a direction 366 until walled cavity 322 contacts walled cavities 324, 320' and/or 322'. When inserts 40 and 42 are coupled together, all walled cavities 320, 322, 324, 320', 322', 324' create interlocking corners with one another.

Figure 17:
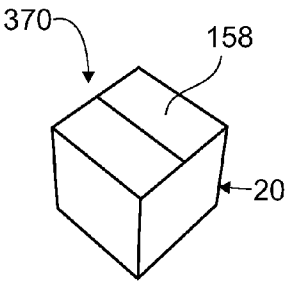
FIG. 17 is a perspective view in a fully articulated of the system of FIG. 16 in a closed position.

Top panels 120, 122, 124, 126 may be rotated to close container 20 and form top 158 of container 20. A fastening mechanism, such as tape or an adhesive, may be used to keep top 158 of container 20 in a closed position 370, as shown in FIG. 17.

IV. Advantages and Performance

System 10 may have equivalent or superior performance when compared to foam based containers, such as EPS coolers. Moreover, system 10 having container 20 and inserts 40, 42 is entirely recyclable in main recycling streams, such as in the paper waste stream. Alternatively, system 10 having container 20 and inserts 1140, 1142 is partially recyclable in main recycling streams, such that container 20 is recyclable in the paper waste stream and the biodegradable material will naturally degrade over time in landfills.

Also, system 10 may ship and store in a flat configuration, i.e., container 20, inserts 40, 42, 1140, 1142 may be shipped and stored in an unarticulated configuration. This has a 5.8 to 1 freight and storage advantage as compared to foam based containers. Further, system 10 has easy set-up and assembly. Additionally, system 10 provides improved impact protection over foam based containers.

Moreover, system 10 may have fewer parts, require less labor and time to assembly, less freight, and less warehouse space than foam based containers. Less freight may use less fuel, which may result in less carbon dioxide emissions. For example, replacing a standard 12"×10"×7", 1.5" foam based container (EPS cooler) with system 10 may result in 1.25 pounds of less landfill waste. Further, system 10 is highly durable.

Figure 18:
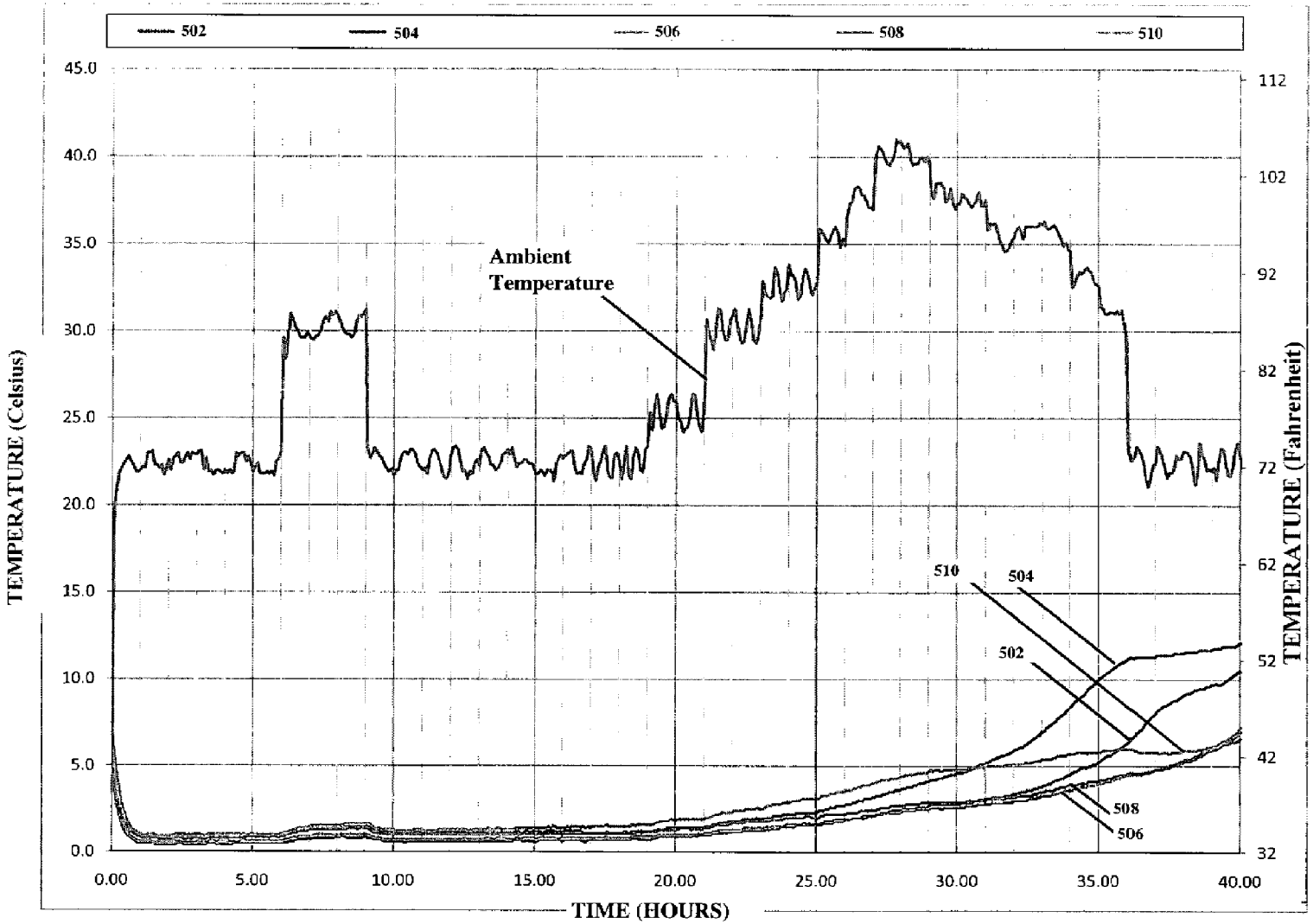
FIG. 18 is a comparison chart of the performance of the system of FIG. 1 as compared to foam based containers.

Turning to FIG. 18, a comparison chart of the performance of system 10, including container 10, inserts 40, 42 and insulating pads 50, wherein insulating pads 50 were about 1" thick (as shown by line 502 on FIG. 18) and system 10 including container 10, inserts 40, 42 and insulating pads 50, wherein insulating pads 50 were about 1.5" thick (as shown by line 504 on FIG. 18) as compared to the performance of to other insulating containers (shown by lines 506, 508, 510 on FIG. 18), such as a foam based container. At least one other insulating container included an outer corrugated paperboard layer and foam lining the inside of the container.

To compare the performance of the containers, each container was packed with the same materials. The materials included one carton of ten 2 mL syringes; each syringe was filled with water. The materials also included at least two layers of gel and bubble wrap.

Both system 10 and the other containers were closed and were placed in an environment where the ambient temperature was varied over a span of about 36 hours, as shown in FIG. 18. As the ambient temperature was changed, system 10 and the other container were each measured to see whether the temperature of the product packed inside would change. This test was completed to determine whether system 10 would substantially maintain the temperature of the products packed therein over time while the ambient temperature was varied. Specifically, the test was intended to replicate a scenario of shipping system 10, as sometimes when systems are shipped, the temperature conditions can be extreme.

As shown in FIG. 18, system 10 (shown by lines 502 and 504 of FIG. 18) performed just as well or better than other containers.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A system comprising:

a container; and an insert assembly comprising an insert configured to be inserted into the container, wherein the insert is fabricated from at least two blanks;

a first blank comprises:

a center panel;

two bottom panels emanating from opposite side edges of the center panel, wherein each bottom panel has at least one slot;

at least one top panel emanating from a top edge of each of the bottom panels, wherein each top panel has at least one tab or flange;

at least one foldable line of weakness disposed between each top panel and bottom panel, wherein the at least one slot of each bottom panel is sized to receive the at least one tab or flange therein; and further wherein a second blank comprises:

a center panel and a plurality of flaps extending from opposite side edges of the center panel, wherein the second blank is configured to couple to the first blank to form at least one walled cavity, the cavity walls including the first blank center panel, the second blank center panel, and the plurality of flaps;

wherein the insert assembly further comprises a second insert fabricated from at least two blanks, wherein the second insert is configured to interlock with the first insert and is configured to be inserted into the container; and wherein each of the insert and second insert are configured to rotate into a C-shape, such that the C-shapes are configured to interlock.

2. A system according to claim 1, wherein each blank is formed from at least one of paper, paperboard and corrugated paperboard, and further wherein the container is formed from at least one of paper, paperboard and corrugated paperboard.

3. A system according to claim 1, wherein the system is assembled without adhering materials.

4. A system according to claim 1, wherein the system is assembled using adhesive materials.

5. A system according to claim 1, wherein the container comprises at least four side panels, and the insert is configured to be inserted into the container such that the at least one walled cavity abuts at least one of the four side panels.

6. A system according to claim 1, wherein the container comprises at least four side panels, and the second insert is configured to be inserted into the container such that the second insert abuts at least one of the four side panels, and the second insert has at least one walled cavity configured to receive an insulating pad therein.

7. A system according to claim 1, wherein the insert assembly further comprises an insulating pad configured to be inserted into the at least one walled cavity of the insert to facilitate insulating the container, and further wherein the insulating pad is fabricated from cellulose fibers.

8. A system comprising:

a container; and an insert assembly comprising an insert configured to be inserted into the container, wherein the insert is fabricated from at least two blanks;

a first blank comprises:

a center panel;

two bottom panels emanating from opposite side edges of the center panel, wherein each bottom panel has at least one slot;

at least one top panel emanating from a top edge of each of the bottom panels, wherein each top panel has at least one tab or flange;

at least one foldable line of weakness disposed between each top panel and bottom panel, wherein the at least one slot of each bottom panel is sized to receive the at least one tab or flange therein; and further wherein a second blank comprises:

a center panel and a plurality of flaps extending from opposite side edges of the center panel, wherein the second blank is configured to couple to the first blank to form at least one walled cavity, the cavity walls including the first blank center panel, the second blank center panel, and the plurality of flaps;

wherein the insert assembly further comprises a second insert fabricated from at least two blanks, wherein the second insert is configured to interlock with the first insert and is configured to be inserted into the container;

wherein each of the insert and second insert are configured to rotate into a C-shape, such that the C-shapes are configured to interlock; and wherein the second insert includes at least a flange configured to enable the C-shapes to interlock.

9. A system according to claim 8, wherein each blank is formed from at least one of paper, paperboard and corrugated paperboard, and further wherein the container is formed from at least one of paper, paperboard and corrugated paperboard.

10. A system according to claim 8, wherein the system is assembled without adhering materials.

11. A system according to claim 8, wherein the system is assembled using adhesive materials.

12. A system according to claim 8, wherein the container comprises at least four side panels, and the insert is configured to be inserted into the container such that the at least one walled cavity abuts at least one of the four side panels.

13. A system according to claim 8, wherein the container comprises at least four side panels, and the second insert is configured to be inserted into the container such that the second insert abuts at least one of the four side panels, and the second insert has at least one walled cavity configured to receive an insulating pad therein.

14. A system according to claim 8, wherein the insert assembly further comprises an insulating pad configured to be inserted into the at least one walled cavity of the insert to facilitate insulating the container, and further wherein the insulating pad is fabricated from cellulose fibers.

* * * * *